US008122530B1

(12) United States Patent
Bailey et al.

(10) Patent No.: US 8,122,530 B1
(45) Date of Patent: Feb. 28, 2012

(54) ROTATABLY POSITIONABLE HAND RAIL

(76) Inventors: John W. Bailey, Bakersfield, CA (US); Steven H. Bailey, Bakersfield, CA (US)

( * ) Notice: Subject to any disclaimer, the term of this patent is extended or adjusted under 35 U.S.C. 154(b) by 0 days.

(21) Appl. No.: 13/197,703

(22) Filed: Aug. 3, 2011

(51) Int. Cl.
*A47K 3/024* (2006.01)

(52) U.S. Cl. ..... 4/576.1; 5/662; 211/105.1; 248/222.52

(58) Field of Classification Search ..... 4/576.1–577.1, 4/571.1; 5/662; 16/444, 446; 211/95, 105.1; 248/222.52, 251, 349, 1, 206.3, 309.1, 346.06; 74/557
See application file for complete search history.

(56) References Cited

U.S. PATENT DOCUMENTS

| | | | | |
|---|---|---|---|---|
| 1,147,348 | A | 7/1915 | Wadsworth | |
| 1,367,290 | A | 2/1921 | Williams | |
| 1,492,277 | A * | 4/1924 | Thompson | 74/557 |
| 1,543,101 | A * | 6/1925 | Crichton | 74/557 |
| 1,725,802 | A | 8/1929 | Hoegger | |
| D93,716 | S | 10/1934 | Hesler | |
| 2,067,591 | A | 1/1937 | Balmer | |
| 2,188,851 | A | 7/1938 | Culver | |
| D118,014 | S | 12/1939 | Grimm | |
| 2,269,420 | A | 1/1942 | Anderson et al. | |
| 2,436,903 | A | 3/1948 | Schafer | |
| 2,564,190 | A | 8/1951 | Danielson | |
| D173,415 | S | 11/1954 | Du Brie | |
| D188,175 | S | 6/1960 | Craig | |
| D189,906 | S | 3/1961 | Best et al. | |
| 3,063,304 | A * | 11/1962 | Manning | 74/557 |
| 3,156,944 | A | 11/1964 | Bohn | |
| D211,877 | S | 8/1968 | Doman | |
| 3,633,862 | A | 1/1972 | Breen | |
| 3,813,071 | A | 5/1974 | Noryd | |
| D233,756 | S | 11/1974 | Schrock | |
| 4,332,263 | A * | 6/1982 | Kitrell | 132/73 |
| D265,582 | S | 7/1982 | Kohler, Jr. | |
| D275,782 | S | 10/1984 | Burgess et al. | |
| D282,963 | S | 3/1986 | Alger | |
| 4,915,331 | A * | 4/1990 | Becker et al. | 248/118 |
| 5,050,252 | A | 9/1991 | Cuttriss | |
| 5,577,275 | A | 11/1996 | Guenther | |
| 7,373,694 | B1 | 5/2008 | Kopp | |
| 7,484,269 | B2 * | 2/2009 | Chih et al. | 16/340 |
| 7,644,903 | B2 * | 1/2010 | Amato et al. | 248/349.1 |
| 7,774,902 | B2 | 8/2010 | Whyzel | |
| 7,874,230 | B2 * | 1/2011 | Maquet | 74/557 |
| 2009/0211013 | A1 * | 8/2009 | Graff et al. | 4/576.1 |

* cited by examiner

*Primary Examiner* — Charles Phillips
(74) *Attorney, Agent, or Firm* — James M. Duncan, Esq.; Klein, DeNatale, et al.

(57) ABSTRACT

An adjustable hand rail has a wall-mountable base member and a bar member which mounts to the wall-mountable base member, an axis is defined by the bar member. The bar member is manually rotatable with respect to the wall-mountable base member. The bar member has means for being selectively locked into any one of a plurality of different axial positions with respect to the wall-mountable base member, including a vertical axial position, a horizontal axial position, and various intermediate axial positions between the vertical axial position and the horizontal axial position.

7 Claims, 6 Drawing Sheets

ROTATABLY POSITIONABLE HAND RAIL

BACKGROUND OF THE INVENTION

The disclosed device relates generally to safety devices which are utilized to support and balance a person, and more specifically to provide a person with a handhold to prevent a fall, or as device to grab if the person loses their footing and starts to fall. Such devices are routinely used in bathtubs, showers, bathrooms, and adjacent to stairs and steps. Presently known hand rails generally are mounted in a fixed position, which generally vary from horizontal, vertical, or, when adjacent to stairs or steps, at an angle which corresponds to the angle of the stairs or steps. Because the position of the hand rail is fixed, the user must have his or her hand in one general position in order to grab the bar. However, it is not always possible for a user to easily position their hands in a position which is conducive to obtaining and maintaining a secure grasp of the rail. For example, for a variety of health-related reasons, many people have limited range of motion in their elbows, wrists, and/or shoulders, which can make the positioning of the hand in a position allowing the most secure handhold to be problematic for a hand rail having a fixed position. Because the hand rail must reliably support the user's entire weight, the inability to obtain and maintain a secure grasp on the rail may defeat the purpose for which the rail is intended.

SUMMARY OF THE INVENTION

Embodiments of the presently disclosed invention provide a solution to the need identified above. The disclosed invention provides a hand rail which has a plurality of easily selectable rotational positions, in addition to a vertical and horizontal orientation. The ability to select a particular rotational position allows the user to set the hand rail at a desired rotational position, where such position allows the user to obtain and maintain a comfortable and secure grasp of the hand rail.

An embodiment of the adjustable hand rail has a wall-mountable base member comprising a circular plate having an inward facing side and an outward facing side. The circular plate has a peripheral edge and a circular track integrally attached at the peripheral edge. The circular track has a bottom from which extend an inside rail member and outside rail member, where the two rail members are parallel with one another. A c-shaped channel is defined by the inside rail member and the outside rail member, where the channel has an outward facing opening opposite the bottom of the circular track. The bottom of the circular track has a plurality of diametrically opposed aperture pairs, with each aperture having generally the same diameter. The apparatus also has a bar member which comprises a handle section disposed between a first end member and a second end member, where the first end member and the second end member are perpendicular to the handle section. Each end member has a pin member sized to fit within any of the apertures. Each end member also has a shoulder member which is larger than the outward facing opening of the c-shaped channel, where each shoulder member is disposed within the c-shaped channel. A biasing means, such as a spring, urges the two pin members of the bar member into a pair of diametrically opposed apertures.

DETAILED DESCRIPTION OF THE EMBODIMENTS

Figure 2:
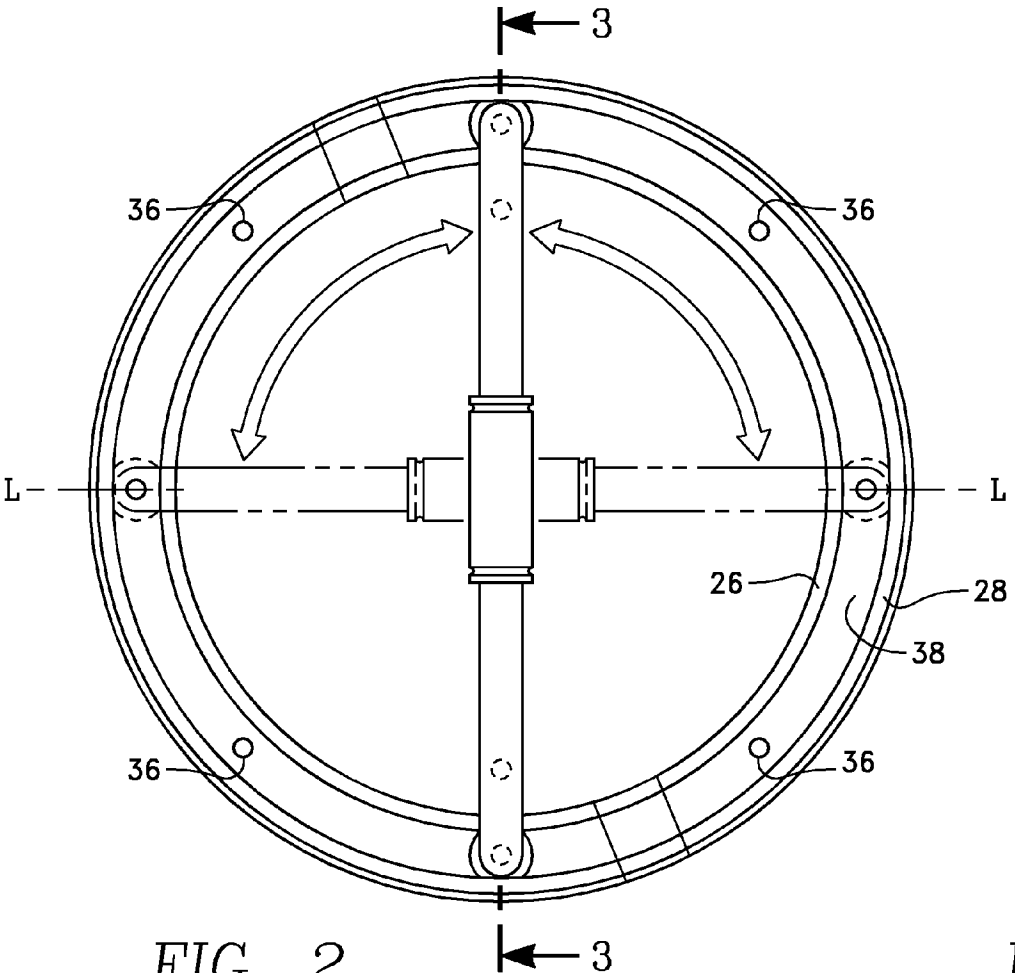
FIG. 2 shows a front view of the embodiment of the disclosed hand rail depicted in FIG. 1.

Referring now to the figures, embodiments of the disclosed hand rail 10 are depicted in FIGS. 1 through 8. As a general description, the adjustable hand rail 10 comprises a wall-mountable base member 12 and a bar member 40 which mounts to the wall-mountable base member, where the bar member generally defines an axis L. The bar member 40 is manually rotatable with respect to the wall-mountable base member 12. The bar member 40 comprises means for being selectively locked into any one of a plurality of different axial positions with respect to the wall-mountable base member 12. As shown in FIG. 2, these axial positions include a vertical axial position (shown in solid line) and a horizontal axial position (shown in broken line). In addition, the bar member 40 may be selectively locked into various intermediate axial positions between the vertical axial position and the horizontal axial position.

More specifically, the apparatus 10 may comprise a wall-mountable base member 12 comprising a circular plate 14 having an inward facing side 16 and an outward facing side 18. The circular plate 14 has a peripheral edge 20. A circular track 22 is located at the peripheral edge 20. The circular track 22 may be an integral part of the circular plate 14 as shown in FIG. 3.

The circular track 22 has a bottom 24 from which extend an inside rail member 26 and outside rail member 28 which cantilever from the bottom. As shown best in FIGS. 4 and 5, the two rail members 26, 28 are generally parallel or concentric with one another except at the free ends, each which respectively has a flanged end 30, 32. A c-shaped channel 38 is defined by the inside rail member 26 and the outside rail member 28, where the channel has an outward facing opening 34 opposite the bottom 24 of the circular track 22. The bottom of the circular track has a plurality of diametrically opposed apertures 36, each aperture having a diametrically opposed mate, such that diametrically opposed pairs of apertures 36 are formed. All of the apertures 36 have approximately equivalent diameters.

Figure 4:
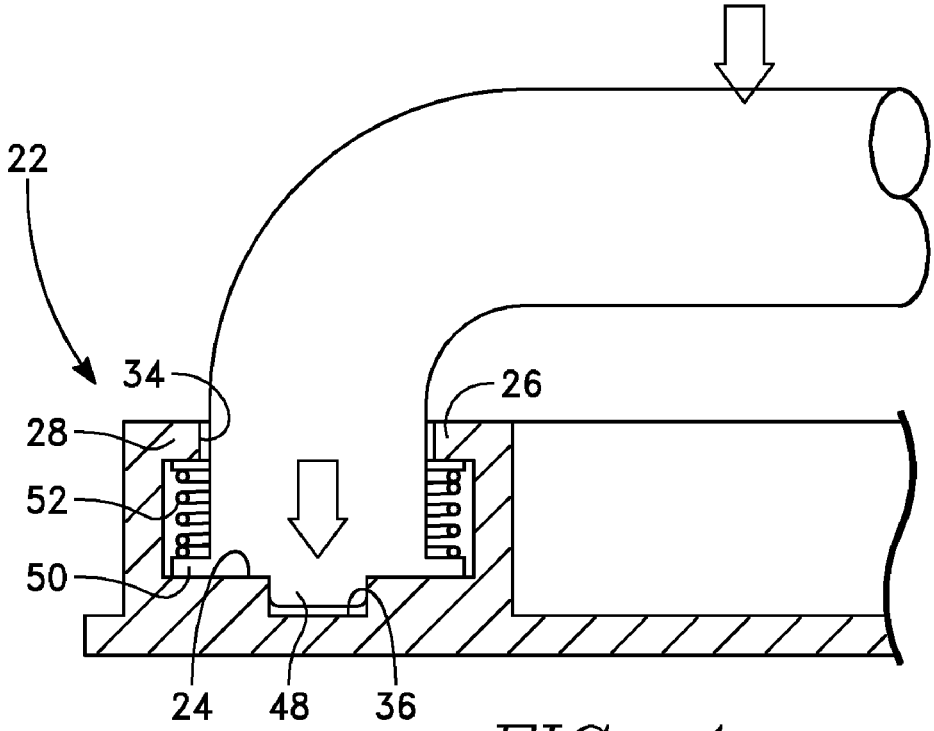
FIG. 4 shows a detailed view of an embodiment of rotational locking mechanism in the locked position, which mechanism may be utilized in embodiments of the disclosed hand rail.
Figure 5:
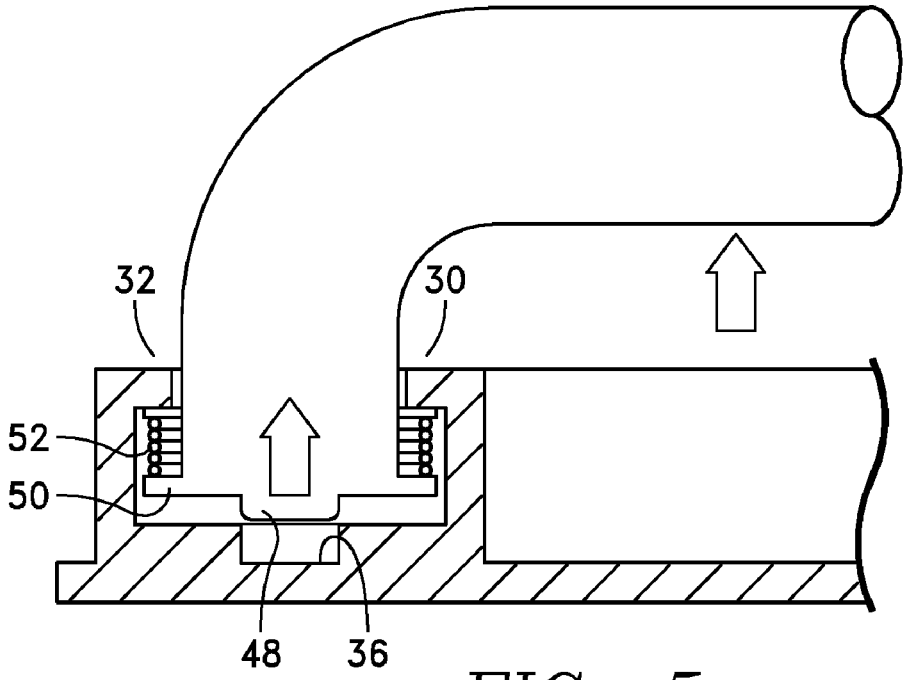
FIG. 5 shows a detailed view of the rotational locking mechanism shown in FIG. 4 in the unlocked position.

The hand rail 10 also has a bar member 40 which comprises a handle section 42 disposed between a first end member 44 and a second end member 46. The first end member 44 and the second end member 46 are perpendicular to the handle section 42. Each end member 44, 46 has a pin member 48 sized to fit within any of the apertures 36. Each end member 44, 46 also has shoulder member 50 which is larger than the outward facing opening 34 of the c-shaped channel 38. As best shown in FIGS. 4 and 5, each shoulder member 50 is disposed within the c-shaped channel 38. A biasing means, such as a spring 52, urges the two pin members 48 of the bar member 40 into a pair of diametrically opposed apertures 36. As best shown in FIG. 3, bar member 40 may comprise a handle 54 which provides an improved gripping structure for a user.

Figure 1:
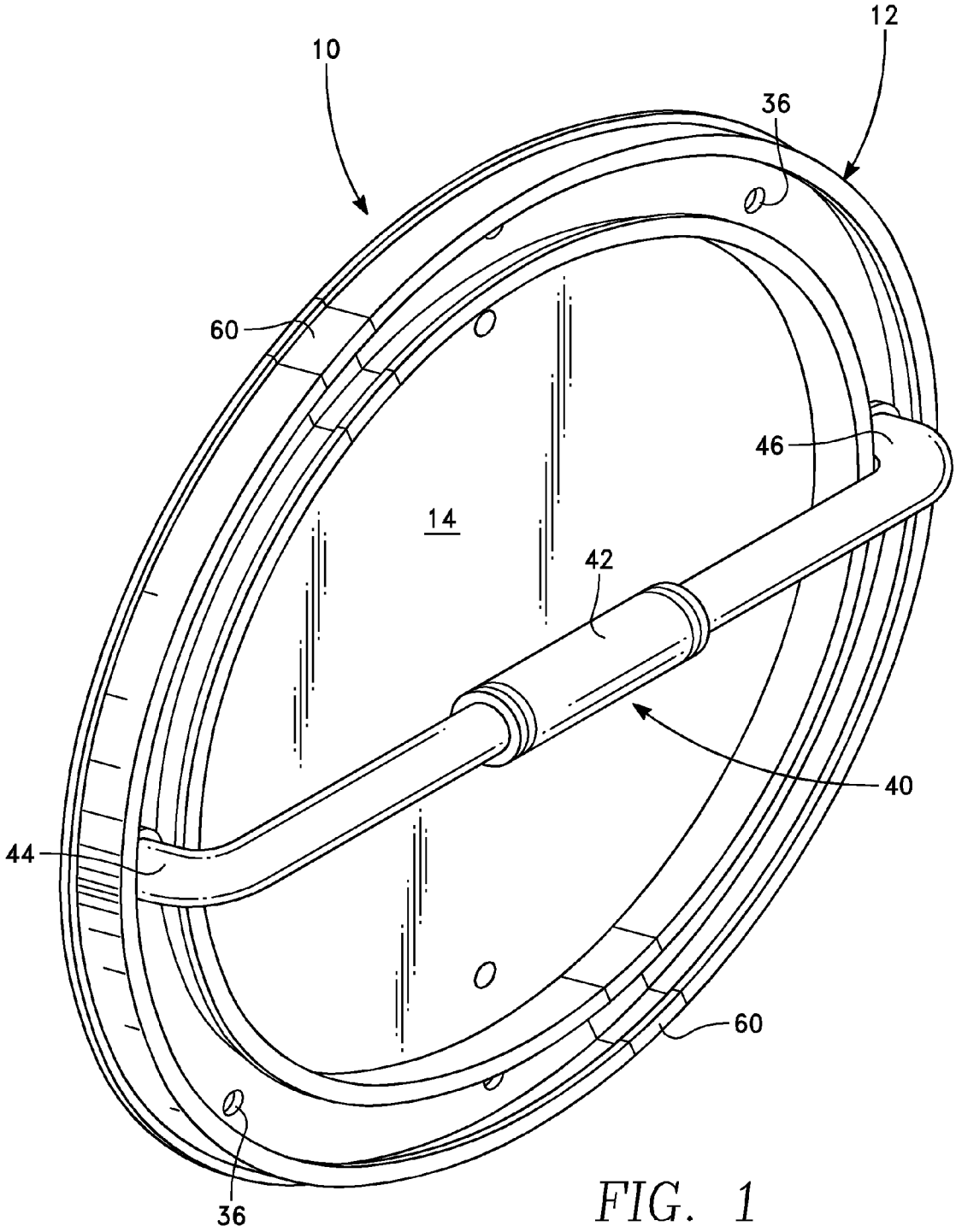
FIG. 1 shows a perspective view of an embodiment of the disclosed hand rail.
Figure 3:
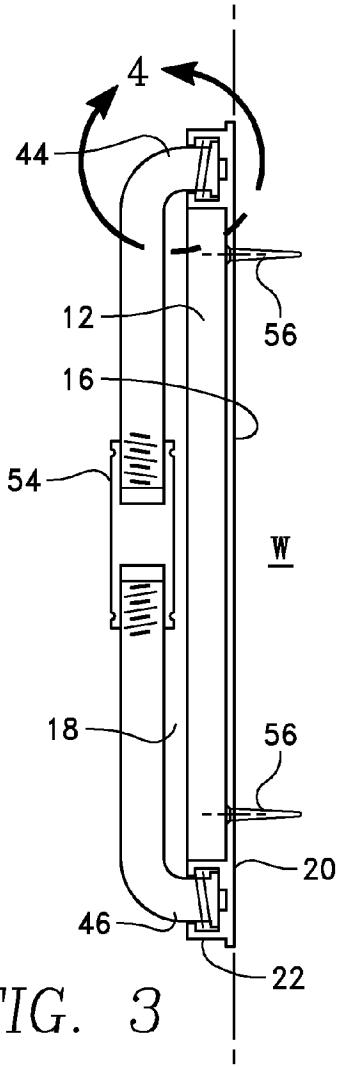
FIG. 3 shows a sectional view along line 3-3 of FIG. 2.

FIG. 3 shows how the base member 12 is mounted to a wall W by anchors 56. Anchors 56 should be selected according to the anticipated loads to which the device will be subjected.

Figure 6:
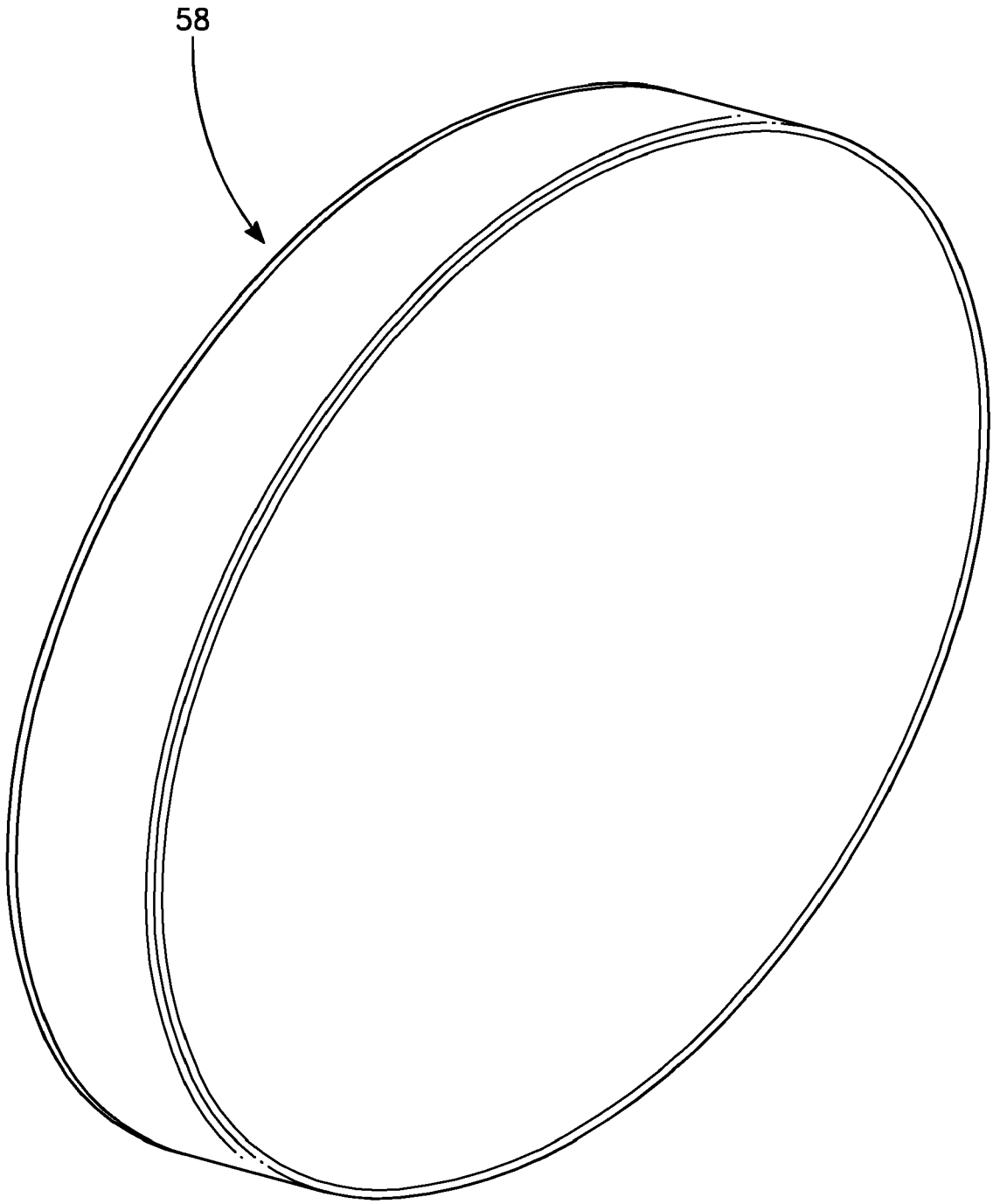
FIG. 6 shows an embodiment of a cover plate which may be utilized with embodiments of the present invention.
Figure 7:
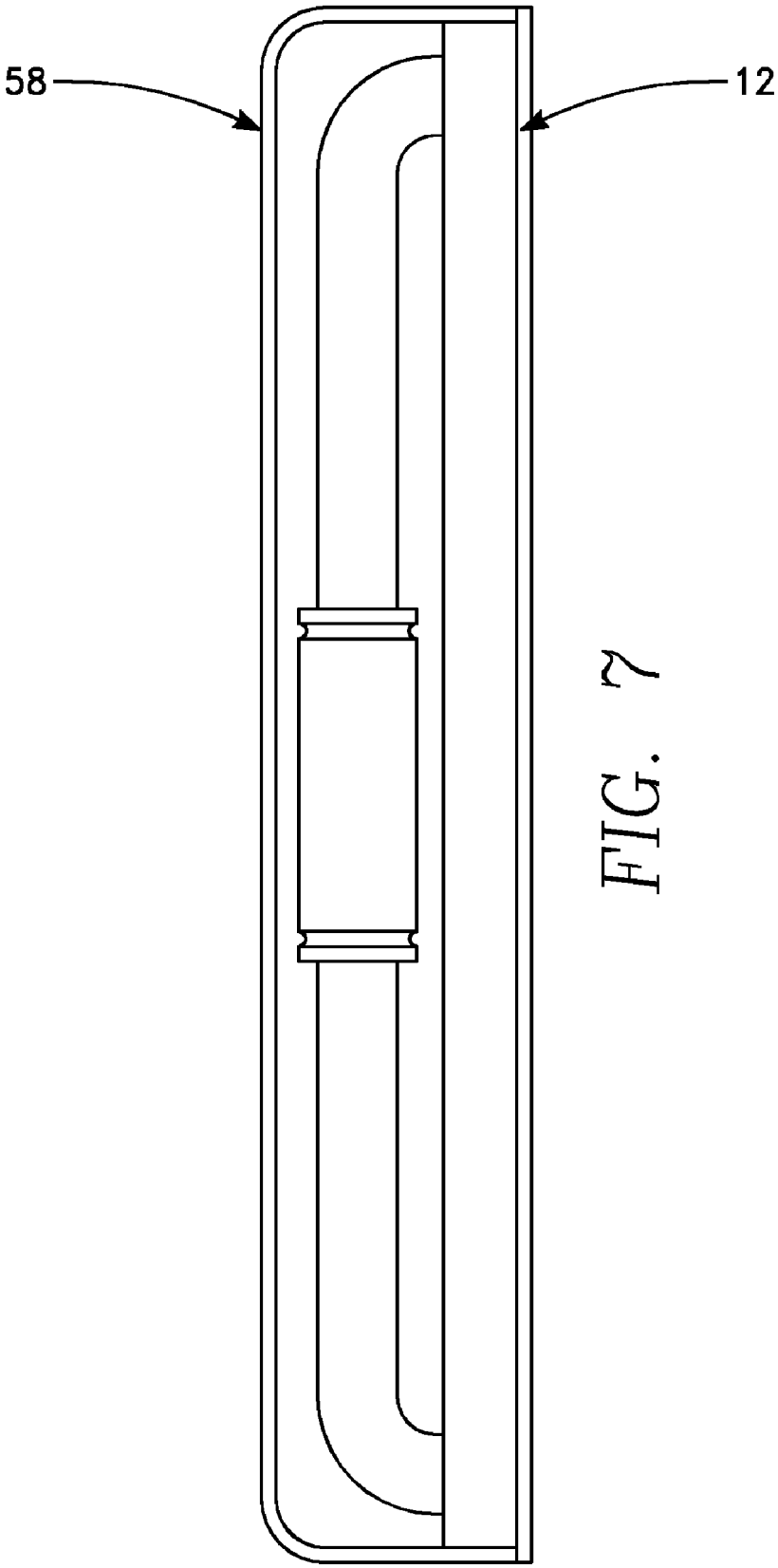
FIG. 7 shows an embodiment of the present invention with the cover of FIG. 6 attached.
Figure 8:
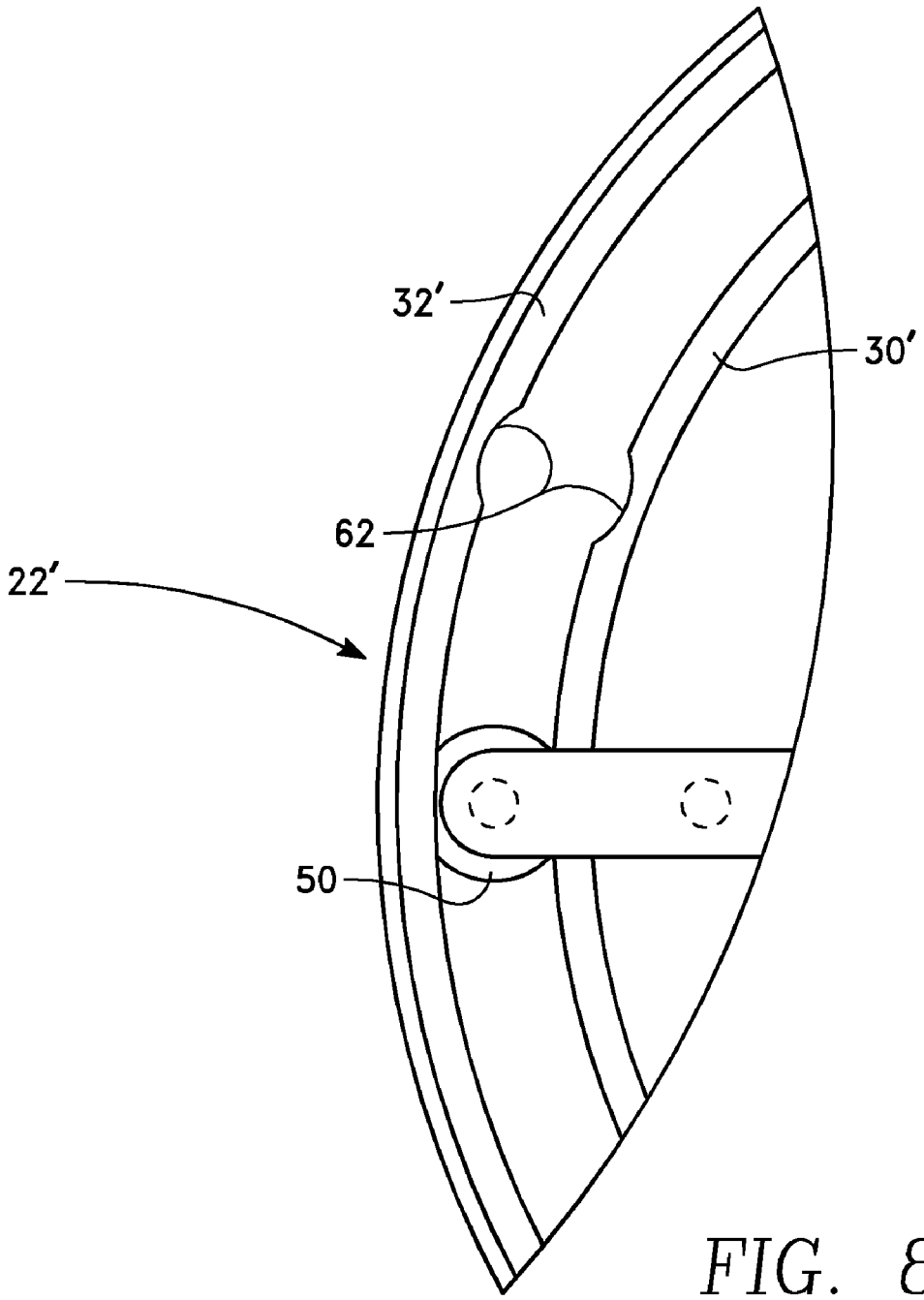
FIG. 8 shows a detailed view of an embodiment of mounting plate which may be utilized with the present invention.

FIG. 6 depicts a cover member 58 which may be utilized with the disclosed hand rail 10. Depending upon the use and location of the hand rail 10, it may be desirable to cover the device from view with an aesthetically pleasing cover member 58, which may simply snap fit over the outside edge of the base member 12 as depicted in FIG. 7. Alternatively, the cover member may comprise a two-piece clam shell configuration, which opens to allow access to the handle member. This type of cover may be configured such that the user simply pushes the outside of the cover member to gain access to the bar member 40 on the inside. The two pieces may be spring loaded such that the cover closes when the user removes his or her hand from the bar member 40.

Installation of the shoulder member 50 into the c-shaped channel 38 may be accomplished by utilizing track sections 60 which are removable from the circular track 22. The track sections 60 are wide enough such that when the track sections are removed, the shoulder members 50 may pass through and be installed within the c-shaped channel 38. Alternatively, as shown in FIG. 7, a circular track 22' may comprise a pair of enlarged openings 62 through the flanged ends 30', 32' which are diametrically disposed within the circular track. The cutout sections 62 will be large enough to allow passage of the shoulder members 50.

The hand rail 10 is manufactured from materials which provide the required mechanical properties for the anticipated service as well as providing an attractive finish which has the required durability for the particular service. In general, because the hand rail must support anticipated impact loads from a person falling, the required mechanical properties will dictate the proper material for construction, such as stainless steel, although certain high strength plastic materials may also be utilized.

While the above is a description of various embodiments of the present invention, further modifications may be employed without departing from the spirit and scope of the present invention. For example, the size, shape, and/or material of the various components may be changed as desired. Thus the scope of the invention should not be limited by the specific structures disclosed. Instead the true scope of the invention should be determined by the following appended claims.

What is claimed is:

1. An adjustable hand rail comprising:

a wall-mountable base member comprising a circular plate having an inward facing side and an outward facing side, the circular plate comprising a peripheral edge, the base member further comprising a circular track member disposed at the peripheral edge;

the circular track member comprising a bottom, an inside rail member extending from the bottom and an outside rail member extending from the bottom, the inside rail member concentric with the outside rail member, wherein the inside rail member and the outside rail member define a c-shaped channel having an outward facing opening opposite the bottom;

the bottom of the track member further comprising a plurality of diametrically opposed aperture pairs, wherein all of the apertures of the aperture pairs have generally the same diameter;

a bar member comprising a handle section disposed between a first end member and a second end member, wherein the first end member and the second end member are generally perpendicular to the handle section;

the first end member comprising a first end comprising a first pin member having a diameter sized to fit within any one of the apertures, the first end member further comprising a first shoulder member larger than the outward facing opening of the c-shaped channel, the first pin member and the first shoulder member disposed within the c-shaped channel;

the second end member comprising a second end comprising a second pin member having a diameter sized to fit within any one of the apertures, the second end member further comprising a second shoulder member larger than the outward facing opening of the c-shaped channel, the second pin member and the second shoulder member disposed within the c-shaped channel; and biasing means for urging the first pin member and the second pin member into a pair of diametrically opposed apertures.

2. The adjustable hand rail of claim 1 wherein the circular track is an integral part of the circular plate.

3. The adjustable hand rail of claim 1 wherein the inside rail member and the outside rail member each comprise a flanged end.

4. The adjustable hand rail of claim 1 wherein the circular track member comprises two removable track sections through which the first should member and the second shoulder member may be inserted.

5. The adjustable hand rail of claim 3 wherein the circular track member comprises a pair of diametrically enlarged openings through the flanged ends of the inside rail member and the outside rail member through which the first shoulder member and the second shoulder member may be inserted.

6. The adjustable hand rail of claim 1 wherein the bar member comprises a handle having a gripping structure.

7. The adjustable hand rail of claim 1 further comprising a cover member which attaches by friction fit to the wall-mountable base member.

* * * * *